US006374858B1

(12) United States Patent
Hides et al.

(10) Patent No.: US 6,374,858 B1
(45) Date of Patent: Apr. 23, 2002

(54) VORTEX VALVES

(75) Inventors: Stephen Peter Hides, Scarborough, ME (US); Robert Yaw Gyamfi Andoh, Mitcham (GB)

(73) Assignee: Hydro International PLC, Clevedon (GB)

( * ) Notice: Subject to any disclaimer, the term of this patent is extended or adjusted under 35 U.S.C. 154(b) by 0 days.

(21) Appl. No.: 09/623,050

(22) PCT Filed: Mar. 1, 1999

(86) PCT No.: PCT/GB99/00606

§ 371 Date: Oct. 11, 2000

§ 102(e) Date: Oct. 11, 2000

(87) PCT Pub. No.: WO99/43899

PCT Pub. Date: Sep. 2, 1999

(30) Foreign Application Priority Data

Feb. 27, 1998 (GB) ..... 9804270

(51) Int. Cl.[7] ..... F15C 1/16

(52) U.S. Cl. ..... 137/813; 137/810; 137/812; 137/315.11; 417/360

(58) Field of Search ..... 417/360; 137/810, 137/812, 813, 315.11

(56) References Cited

U.S. PATENT DOCUMENTS

| | | | | |
|---|---|---|---|---|
| 3,195,303 A | | 7/1965 | Widell | |
| 3,215,165 A | | 11/1965 | Boadway | |
| 3,219,048 A | | 11/1965 | Palmisano | |
| 3,513,865 A | | 5/1970 | Van Der Heyden | |
| 3,521,657 A | | 7/1970 | Ayers | |
| 3,638,672 A | | 2/1972 | Smith et al. | |
| 3,712,321 A | | 1/1973 | Bauer | |
| 3,722,522 A | | 3/1973 | Randall | |
| 3,753,496 A | | 8/1973 | Boyd | |
| 3,815,748 A | | 6/1974 | Johannessen | |
| 3,827,461 A | | 8/1974 | Gilman | |
| 3,851,898 A | | 12/1974 | Ihara | |
| 3,880,553 A | * | 4/1975 | Wolford et al. | 417/360 |
| 4,177,947 A | | 12/1979 | Menzel | |
| 4,206,783 A | | 6/1980 | Brombach | |
| 4,441,403 A | | 4/1984 | Hansen | |
| 4,679,595 A | | 7/1987 | Johannessen | |

(List continued on next page.)

FOREIGN PATENT DOCUMENTS

| | | |
|---|---|---|
| DE | 26 43 029 | 3/1978 |
| DE | 26 58 619 | 6/1978 |
| DE | 3435477 A1 | 3/1986 |
| EP | 0 089 1861 | 9/1983 |

(List continued on next page.)

OTHER PUBLICATIONS

Das Gas–Und Wasserfach, vol. 123, No. 3, 1982, pp. 166–167, Munich, DE; Wasser/Abwasser: "Mehr als 500 Wirbeldrosseln und Wirbelventile im Einsatz".

*Primary Examiner*—A. Michael Chambers
(74) *Attorney, Agent, or Firm*—Larson & Taylor PLC

(57) ABSTRACT

A vortex valve flow control includes a housing defining a vortex chamber having an inlet for introducing a liquid into the vortex chamber in a manner to promote swirl and an outlet in one axial end of the vortex chamber. The peripheral wall of the of the vortex chamber, which is situated between the two end walls and surrounds the longitudinal axis of the vortex chamber, has a cylindrical cross-section. The distance between the end walls of the vortex chamber is no more larger than the diameter of the vortex chamber. A mounting device mounts a vortex valve flow control in a drainage gully whereby the outlet of the vortex valve communicates with the outlet from the gully. The mounting device includes a first element being securable to an end wall about the outlet opening and a second element mountable in or adjacent the outlet opening of the gully.

6 Claims, 5 Drawing Sheets

U.S. PATENT DOCUMENTS

Figure 1B:
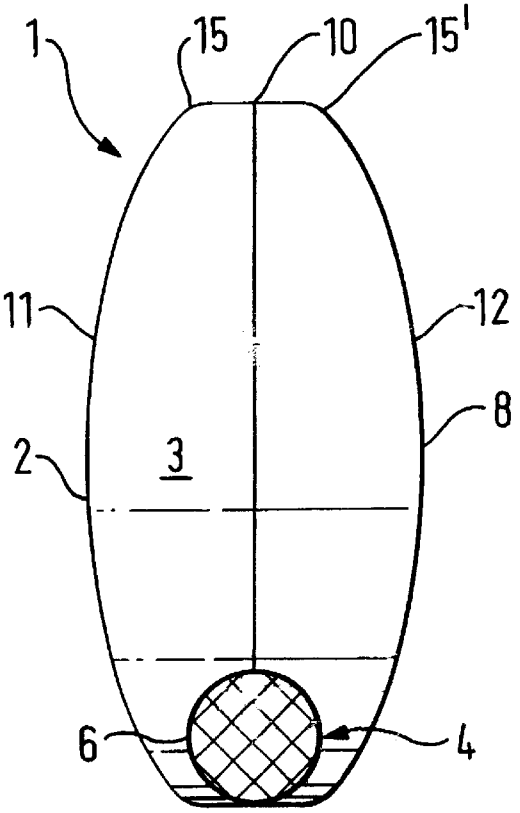

| | | | | | |
|---|---|---|---|---|---|
| 4,726,742 | A | * | 2/1988 | Harbison et al. | 417/360 |
| 4,834,142 | A | | 5/1989 | Johannessen | |
| 4,846,224 | A | | 7/1989 | Collins, Jr. et al. | |
| 4,889,166 | A | | 12/1989 | Lakatos | |
| 5,038,817 | A | | 8/1991 | Henry et al. | |
| 5,052,442 | A | | 10/1991 | Johannessen | |
| 5,080,137 | A | * | 1/1992 | Adams | 137/810 |
| 5,337,789 | A | * | 8/1994 | Cook | 137/812 |
| 5,524,393 | A | | 6/1996 | Nill et al. | |
| 5,640,988 | A | | 6/1997 | Brereton | |
| 5,700,041 | A | | 12/1997 | Andre et al. | |

FOREIGN PATENT DOCUMENTS

| | | | |
|---|---|---|---|
| FR | 2 365 713 | | 4/1978 |
| GB | 653394 | | 5/1951 |
| GB | 1053302 | | 12/1966 |
| GB | 1125931 | | 9/1968 |
| GB | 1156218 | | 6/1969 |
| GB | 1159739 | | 7/1969 |
| GB | 1164730 | | 9/1969 |
| GB | 1 256 903 | | 12/1971 |
| GB | 1 270 228 | | 4/1972 |
| GB | 1 305 944 | | 2/1973 |
| GB | 1 335 876 | | 10/1973 |
| GB | 1 339 642 | | 12/1973 |
| GB | 1 376 746 | | 12/1974 |
| GB | 1 407 836 | | 9/1975 |
| GB | 1 441 389 | | 6/1976 |
| GB | 1 526 957 | | 10/1978 |
| GB | 2 133 902 | A | 8/1984 |
| GB | 2 141 561 | A | 12/1984 |
| GB | 2 190 719 | A | 11/1987 |
| GB | 2 210 995 | A | 6/1989 |
| GB | 2 254 938 | A | 10/1992 |
| WO | WO 89/08750 | | 9/1989 |
| WO | WO 92/04667 | | 3/1992 |
| WO | WO 92/08059 | | 5/1992 |
| WO | WO 94/05867 | | 3/1994 |
| WO | WO 94/08146 | | 4/1994 |
| WO | WO 99/43899 | | 2/1999 |

* cited by examiner

VORTEX VALVES

This invention relates to vortex valve flow controls.

A vortex valve flow control is a device for controlling fluid flow by a hydraulic effect without requiring moving parts. Such devices have a vortex chamber provided with an outlet at one axial end and an inlet arranged to cause swirl in the chamber when a certain critical flow has been attained. In use, the inlet communicates with a body of water which exerts a pressure head on the liquid entering the vortex chamber. Air is entrained in the liquid drawn through the valve so that, when vortex flow has been established, a central air core exists. U.S. Pat. No. 4,206,783 discloses a vortex valve having a conical vortex chamber with a tangential inlet and an outlet disposed at the narrower end of the chamber. Also known are short vortex valves of which the cross-sectional configuration of the vortex chamber is a logarithmic spiral extending the full length of its longitudinal axis to the outlet. At low flow rates, water entering through the inlet of a vortex valve passes through the vortex chamber to the outlet with substantially no pressure drop and the valve can be considered to be open. However, at high flow rates, water enters through the inlet with enough energy to create a vortex in the vortex chamber which results in a considerable pressure drop between the inlet and the outlet and may greatly restrict flow through the outlet, or even substantially cut it off altogether. Thus the valve serves to limit the rate of flow through it automatically. Vortex valves can be used, for example, to control the flow of storm water in sewers, to ensure that equipment downstream of the valve is not overloaded during periods of heavy rainfall.

The flow characteristics of a vortex valve flow control (once a vortex has been initiated in the vortex chamber thereof) are dependent on a number of factors including the area of the outlet (A) and the head (H) of fluid upstream of the device. A reasonable approximation of the relationship between the flow (Q) through a vortex valve flow control and the area of the outlet (A) and head (H) is given by the equation:

$$Q=C_d \cdot A\sqrt{(2gH)}$$

where $C_d$ is a coefficient of discharge which is dependent upon the type of vortex valve under consideration, and g is the gravity constant.

Before initiation of the vortex, the rate of flow of fluid through the device is directly dependent upon the head (H) and the area (A) of the outlet. In the "pre-initiation" zone (i.e shortly before initiation), the flow actually decreases somewhat for a small increase in head, before increasing again at initiation at a slower rate than before. This gives rise to what is termed a "pre-initiation bulge" during which the characteristics of the vortex valve are such that it permits a higher rate of flow for a given pressure head than one would expect from a direct extrapolation back towards the origin of the curve at high heads after initiation. In some circumstances, it is desirable to reduce or even eliminate the pre-initiation bulge.

The configuration and dimensions of a vortex valve determine its flow characteristics, namely its coefficient of discharge ($C_d$), the extent of pre-initiation bulge and the head required to initiate the vortex.

Until the present invention, it had been the experience that an increase in the dimensions of the outlet from the vortex chamber would cause a change in the coefficient of discharge; thus, in order to maintain a constant coefficient of discharge within a range of vortex valve flow controls having the same overall general configuration, but different outlet opening dimensions, it has previously been necessary to vary other dimensions of the device, including the dimensions of the inlet and the overall dimension (typically the dimension of the longitudinal axis and the diameter) of the vortex chamber itself. As a consequence, it has been necessary for suppliers of vortex valves to manufacture and keep stocks of a wide range of sizes of vortex valve.

The present invention is based on the finding that a vortex valve can be designed with a coefficient of discharge which remains constant over a wide range of outlet dimensions, the only requirement being a corresponding adjustment in the dimensions of the inlet opening. This makes it possible for a supplier of vortex valves to manufacture and stock a single vortex valve "precursor" from which a range of vortex valve flow controls with the same (or substantially the same) coefficient of discharge, but with different outlet opening dimensions, may be constructed. This requires the supplier only to form the appropriate outlet opening and inlet opening in the end wall and peripheral wall respectively of the vortex chamber to create a suitable vortex valve flow control to meet a customer's needs. There are considerable practical as well as economic advantages associated with the ability of a supplier to be able to meet its customers requirements in this way, not least the economic advantage of not having to "customise" each vortex valve to a customer's order.

According to a first aspect of the present invention, there is provided a vortex valve flow control comprising a housing defining a vortex chamber having an inlet for introducing a liquid into the vortex chamber in a manner to promote swirl and an outlet in one axial end of the vortex chamber, characterised in that:

the peripheral wall of the vortex chamber which is situated between the two end walls and surrounds the longitudinal axis of the vortex chamber has a cylindrical cross-section; and the distance between the end walls (as measured at the axis of the flow control) of the vortex chamber is no larger than the diameter of the vortex chamber.

In a preferred embodiment of the vortex valve in accordance with this aspect of the invention, the inlet is an inlet means in the form of an inlet conduit or pipe which is open at both ends, the end thereof which intersects the peripheral wall of the vortex chamber constituting the inlet opening into the vortex chamber.

A further preferred feature is that the intersection or junction between each end wall of the vortex chamber and the cylindrical peripheral wall should take the form of a circumferentially extending concave portion (when viewed from inside the vortex chamber) having a radius of curvature which is typically less than 25% of the diameter of the vortex chamber.

The Peripheral Wall of the Vortex Chamber

The peripheral wall of the vortex chamber which is situated between the two end walls and surrounds the longitudinal axis of the vortex chamber has a cylindrical cross-section, that is to say it should have a constant cross-section along its length.

The peripheral wall of the vortex chamber is preferably of circular cylindrical form, although other cross-sectional forms, such as oblong or elliptical forms are also contemplated

The Inlet Means

The inlet means comprises a conduit or pipe which serves to direct liquid flow to the vortex chamber in a manner to promote swirl of the liquid in the vortex chamber when a predetermined pressure head is reached. The inlet conduit preferably has a circular cross section and is preferably arranged to direct liquid flow tangentially into the vortex chamber. As a consequence of its tangential abutment to the peripheral wall of the vortex chamber, the actual inlet opening in the peripheral wall of the vortex chamber is not circular, but rather has an elliptical form which corresponds to the shape of the end of the inlet conduit at its intersection with the peripheral wall. The length of the tubular conduit is not critical, but typically will be of the order of the inlet or outlet diameter.

The End Walls of the Vortex Chamber

As stated above, the distance between the end walls (as measured at the axis of the flow control) of the vortex chamber is no larger than the diameter of the vortex chamber. Preferably, this distance is no more than 60% of the diameter of the vortex chamber. The depth of the vortex chamber, i.e. its dimension measured along its axis, is thus relatively short compared with its diameter.

The end walls of the vortex chamber may be planar and parallel with each other. Alternatively, each end wall may take a concave form (as viewed from the inside of the vortex chamber), preferably with a relatively large radius of curvature which may, for example, be approximately the same as the diameter of the vortex chamber or may be greater than the diameter of the vortex chamber. A combination of one planar wall and one concave wall is also contemplated.

The outlet opening is disposed axially in one of the end walls of the vortex chamber.

The Junction Between the End and Peripheral Walls

Where the end walls of the vortex chamber are planar, the radius of curvature of the circumferential concave portion is typically less than 5% of the diameter of the vortex chamber. Where the end walls of the vortex chamber are concave, the radius of curvature of the circumferential concave portion is typically between 5% and 25% of the diameter of the vortex chamber.

Construction of Vortex Valves of the Invention

The vortex valve housing may conveniently be constructed from two identical shells which are joined together along a circumferential centre line to form the desired vortex chamber. Where the vortex valve is to be formed of a metal, such as steel, the two halves may be welded together. Where they are made from a plastics material, a suitable technique for joining the two plastic shells should be employed. This could either be by fusion butt welding or another appropriate process for the manufacture of plastic shaped products of similar construction.

Pre-formed housings without an inlet means and outlet opening may be manufactured in bulk and stored ready for a finishing process in which the desired outlet opening and corresponding inlet means are added. Alternatively, the pre-formed housing may be constructed with an axial oversize outlet opening which, when the finished article is to be produced, needs only to be throttled down using a suitable plate having an opening of the correct size in it which is secured axially over the oversize opening.

The inlet means is secured to the vortex chamber housing by suitable inter-penetration methods.

In addition, the vortex valve of the present invention may be provided with a novel mounting means for mounting the vortex valve in position in a drainage gully so that its outlet communicates with the outlet from the gully, which gully outlet normally takes the form of a circular opening in a side wall of the gully which in turn communicates with a drainage pipe extending away from the gully. This novel mounting means (which is an independent aspect of the present invention) enables the vortex valve flow control to be lifted clear of the drainage outlet with relative ease to permit drain-down of the gully and cleaning to take place.

The essential characteristic of this novel mounting means is that it comprises first and second elements, the first element being securable to the end wall of the vortex valve housing about the outlet opening thereof and the second element being mountable in or adjacent the outlet opening of the gully. Alternatively, one or other or both of the first and second elements may be formed integrally with the vortex valve housing and the region of the outlet opening of the gully respectively.

One of the said elements preferably defines a slot which is capable of slidably receiving and locating a suitably shaped head portion of the other of said elements. When located together, the first and second portions form a combined mounting which allows the outlet opening of the vortex chamber to communicate with the outlet opening of the gully in a substantially liquid tight manner.

The slot defined in one of the said elements is preferably oriented vertically and may be in the shape of a truncated wedge, the thin end of the wedge being uppermost, and the wider edge of the wedge being lowermost and serving as the mouth of the slot for slidably receiving the head portion of the second element of the mounting means.

Preferably, the slotted element is securable to (or formed as part of) the vortex valve housing, and the other element, comprising a wedge shaped head portion, is mounted to a spigot which is a push-fit in the outlet opening of the gully.

Figure 1A:
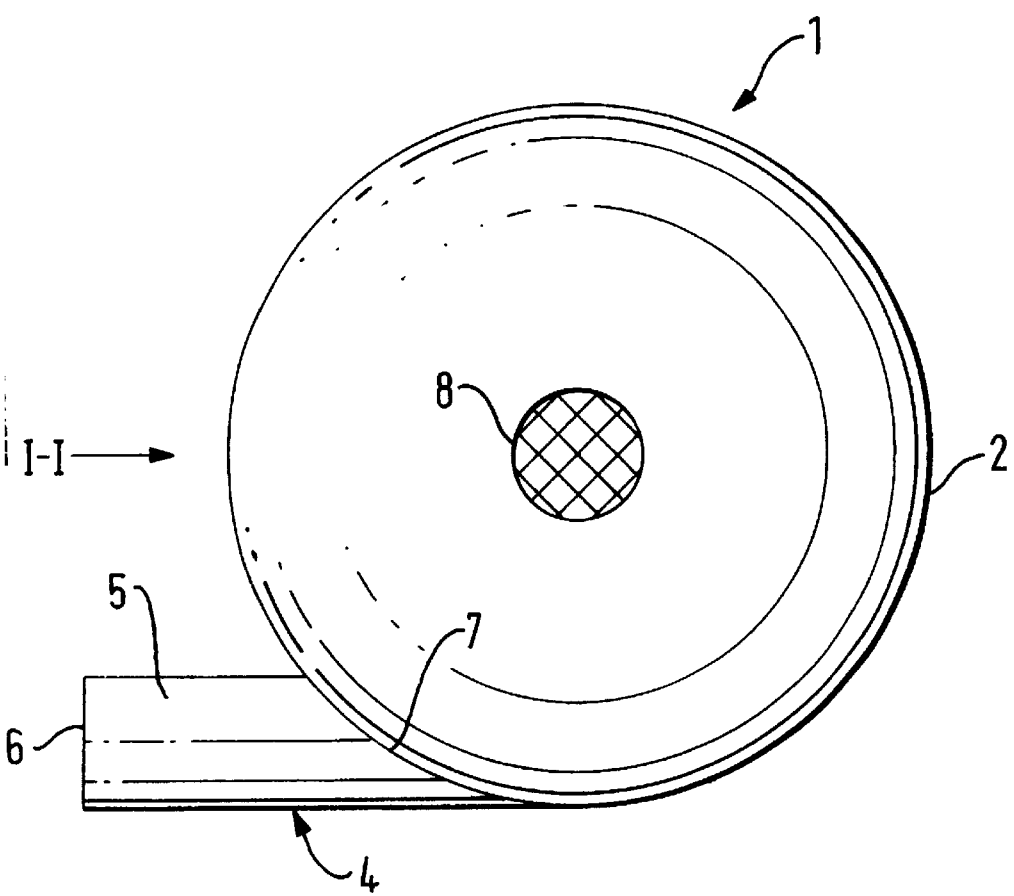

For a better understanding of the present invention, and to show how it may be brought into effect, reference will now be made, by way of example, to the accompanying drawings, in which:

FIG. 1*a* is a view toward one end of a vortex valve flow control in accordance with the present invention and FIG. 1*b* is a view in the direction I—I of FIG. 1*a;*

Figure 2B:
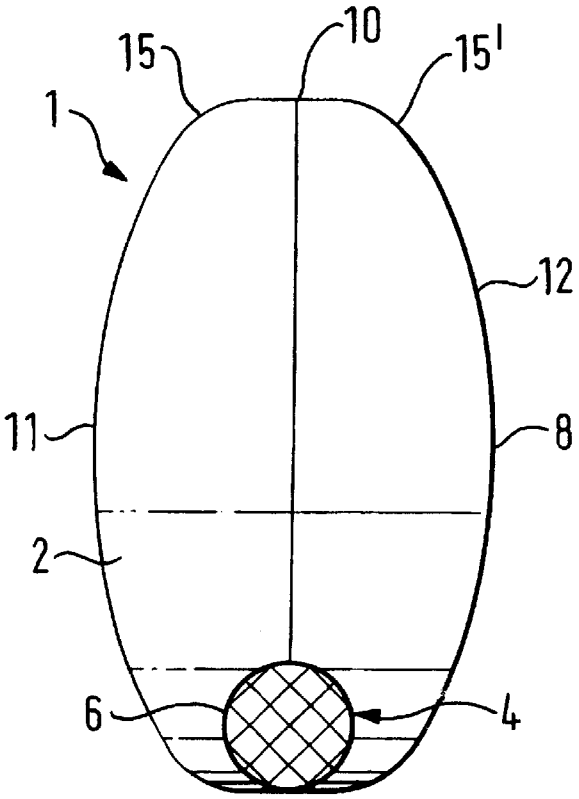
Figure 2A:
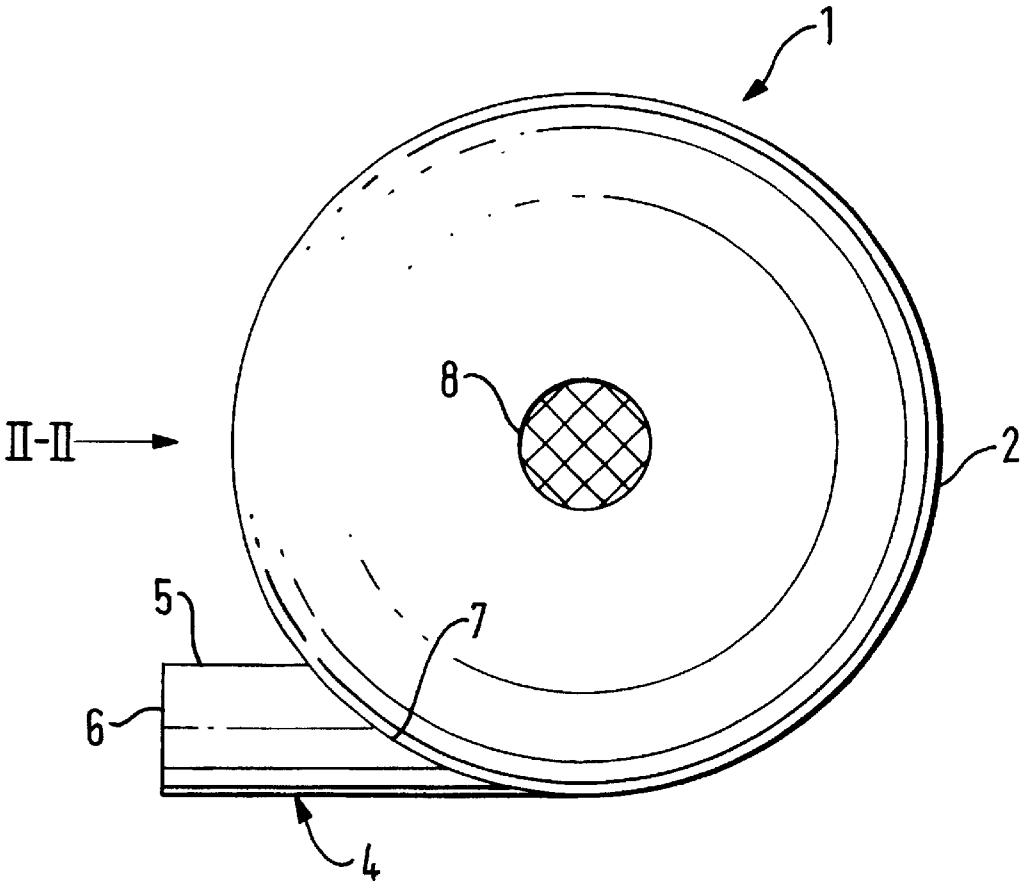

FIG. 2*a* is a view towards one end of another vortex valve flow control in accordance with the present invention and FIG. 2*b* is a view in the direction II—II of FIG. 2*a;*

Figure 3B:
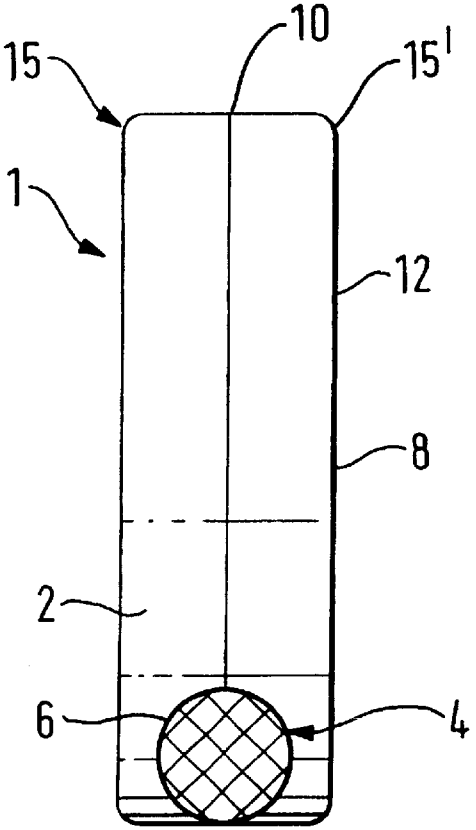
Figure 3A:
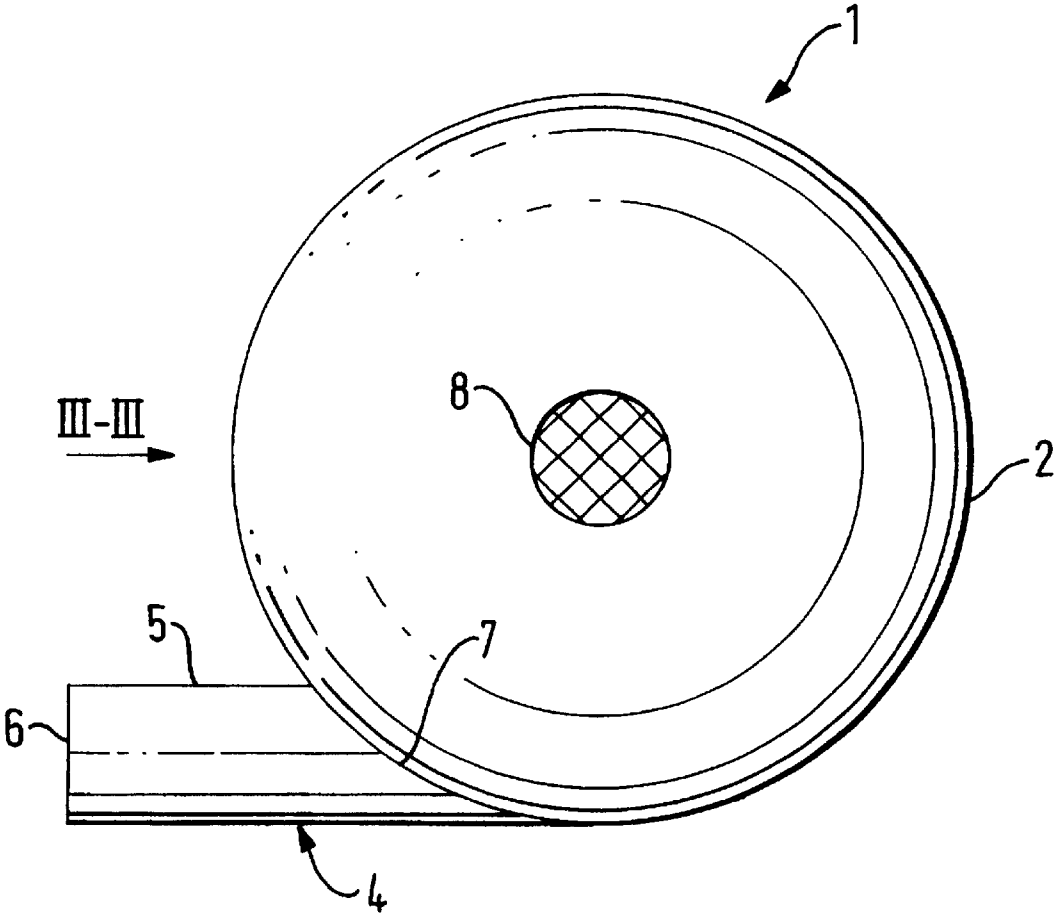

FIG. 3*a* is a view towards one end of a third embodiment of a vortex valve flow control in accordance with the present invention and FIG. 3*b* is a view in the direction III—III in 3*a;*

Figure 4B:
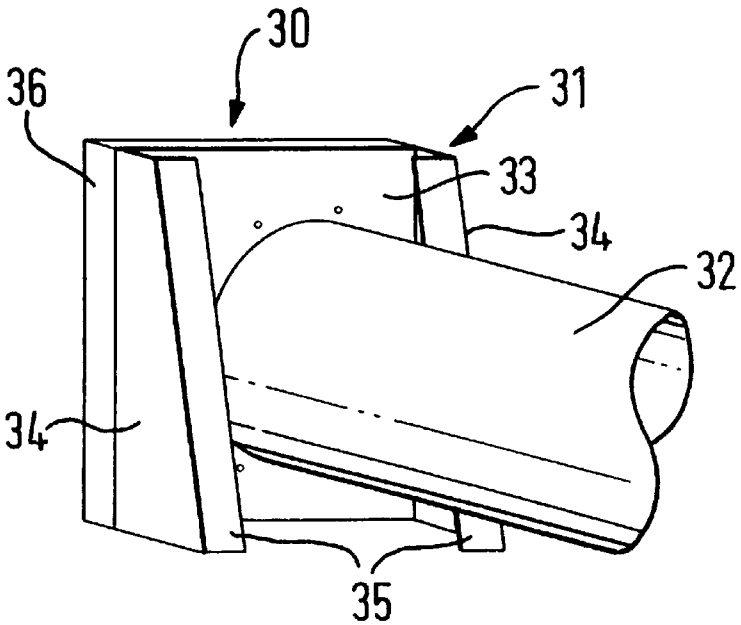
Figure 4A:
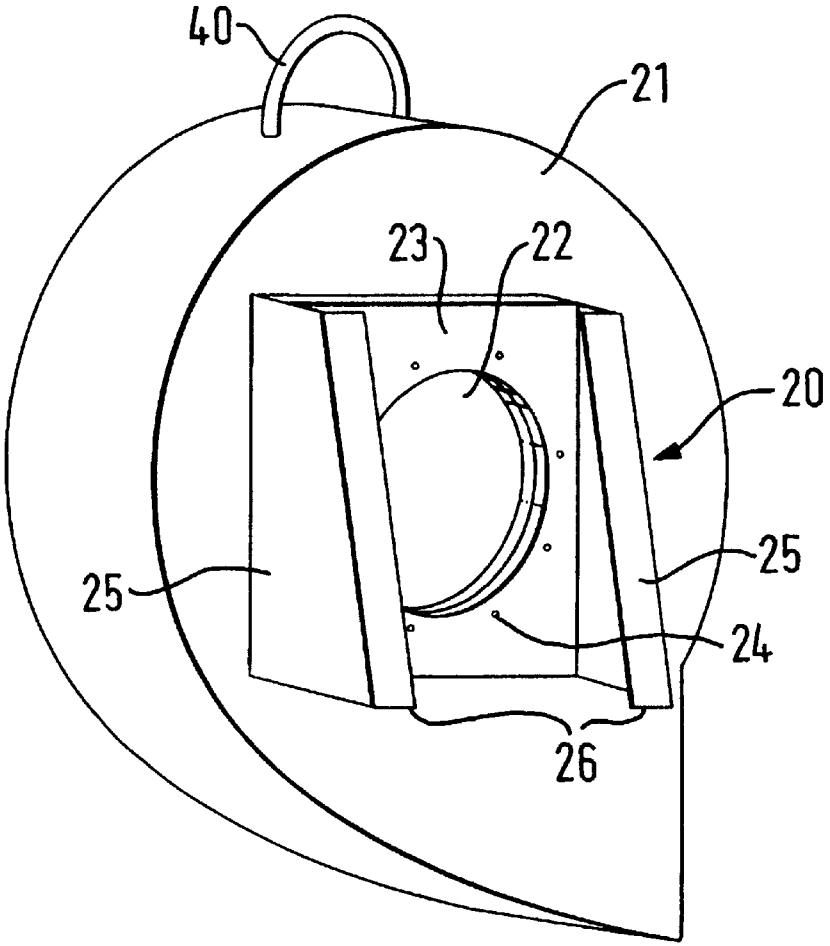

FIG. 4*a* is a perspective view from one side towards a vortex valve having one element of a mounting device in accordance with another aspect of the present invention and FIG. 4*b* is the other part of the mounting device corresponding to that in FIG. 4*a;*

Figure 6A:
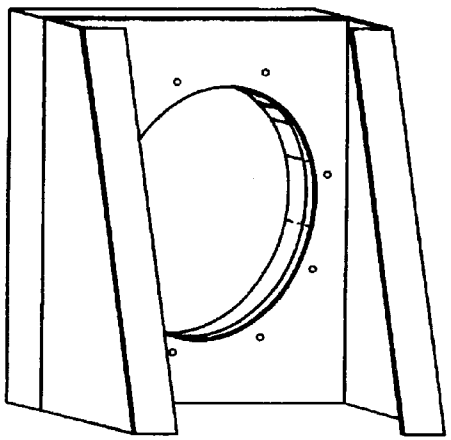
Figure 6B:
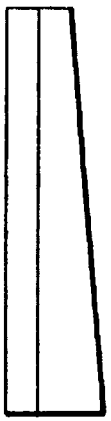
Figure 5A:
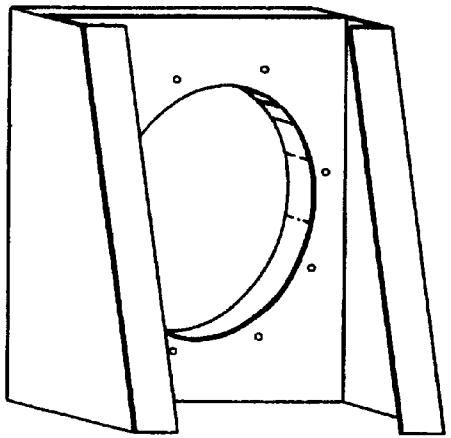
Figure 5B:
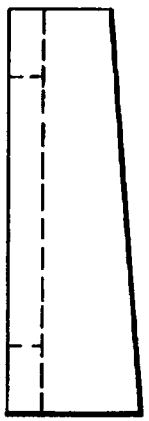

FIGS. 5*a* and 5*b* show a perspective view and a side view respectively of the slotted element of the mounting device of the present invention; and FIGS. 6*a* and 6*b* show a perspective view and a side view of another embodiment of the slotted element of the mounting device in accordance with the present invention.

FIGS. 1*a* and 1*b*; FIGS. 2*a* and 2*b*; and FIGS. 3*a* and 3*b* illustrate different embodiments of a vortex valve in accordance with the present invention. All three embodiments will be defined described together, the only difference between the three being the curvature (or absence of curvature) in the end walls of the vortex valve flow control and the dimensions of the inlet/outlet.

The vortex valve 1 shown in FIGS. 1–3 comprises a housing wall 2 which defines a vortex chamber 3 into which liquid may be introduced via inlet means 4 in a manner to promote swirl within the vortex chamber 3.

The inlet means 4 comprises an inlet pipe 5 having an opening 6 into which liquid may flow and an opening 7 at the intersection with the vortex chamber 3. Inlet means 4 is oriented tangentially to the vortex chamber 3. Disposed axially of the vortex chamber 3 is an outlet opening 8 through which liquid may exit the vortex chamber 3. In the embodiments shown in FIGS. 1–3, the diameter of the inlet 6 and the outlet 8 are the same, although they may be different in different arrangements of vortex valves in accordance with the invention. The vortex chamber 1 has a peripheral wall 10 which is situated between end walls 11 and 12. The peripheral wall 10 surrounds the longitudinal axis of the vortex chamber 3 and is preferably of circular cylindrical form, i.e. it has a constant circular cross-section along its length. This section of the vortex chamber is relatively short compared to the diameter of the vortex chamber.

At the intersection or junction between each end wall 11, 12 and the cylindrical peripheral wall 10 there is a circumferentially extending concave (when viewed from inside the vortex chamber) portion 15 and 15'.

In the embodiment of FIGS. 1*a* and 1*b*, each end wall, 12 of the vortex valve 1 has a concave, or dished, form. In the embodiment shown in FIG. 2*a* and 2*b*, the radius of curvature is somewhat less than the radius of curvature in figure 1*a* and 1*b*. In the embodiment shown in FIG. 3*a* and 3*b*, the end walls 11 and 12 are plainer, and parallel to each other.

The vortex valve shown in FIGS. 1–3 is well suited to a fabrication method in which the vortex valve housing is formed in two shells which may be joined together using a suitable technique, such as welding. It also makes possible the mass production of vortex valves using plastic materials, such as high density polyethylene, polypropylene, PVC or other plastics material used for drainage products.

It has been found that vortex valve flow controls in accordance with the present invention as illustrated in FIGS. 1–3 possess the desirable characteristic that, when the dimension of the outlet is varied, and with a corresponding variation in the diameter of the inlet to the vortex chamber, the coefficient of discharge remains substantially constant.

FIGS. 4*a* and 4*b* illustrate a novel mounting means for a vortex valve flow control. This novel mounting means enables a vortex valve flow control to be mounted in a drainage gully in such a way that it is easily able to be lifted clear of the drainage outlet of the gully to permit drain-down of the gully in which the vortex valve is situated, and cleaning to take place.

The mounting means comprises a first element 20 which is secured to an end wall of a vortex valve flow control 21 about the outlet opening 22 thereof. The first element 20 comprises a back plate 23 which is secured to the end wall of the vortex valve flow control, for example by suitable fixing elements 24. This back plate 24 is provided with projecting sidewall portions 25 each of which has a return flange 26. Sidewalls 25 are each in the shape of a truncated wedge and, together with the return flange 26 define a wedge-shaped slot, the thin end of which is uppermost and the wide end of which faces downwards in use. This slot is capable of receiving and locating a corresponding head portion 30 of a second element 31 of the mounting means as shown in FIG. 4*b*. The second element 31 comprises a hollow spigot 32 which is a push fit in the outlet opening of a drainage gully. The spigot 32, preferably made of metal, is welded to a suitable bracket 33, which bracket is provided with side-portions 34 and return flanges 35. On the front face of the bracket 33 is provided a high-density plastic intermediate layer 36. The shape of the head portion 30 of the second element is such that it corresponds to the shape of the slot in the first element 20 described above. Thus, in use, the outlet spigot 32 is introduced into the outlet opening of a drainage gully (not shown), with the head portion 30 protruding from. The vortex valve flow control may then be lowered onto the head portion 30, for example using handle 40, so that the head portion 30 engages and is located in the slot in the first element 20. The two parts are dimensioned such that there is a substantially watertight fit between the two parts, with the high density plastic intermediate layer assisting in this respect by allowing for varying tolerances between the two elements. The front face of the head element 30 is, of course, provided with a suitable opening (not shown) which is in alignment with the outlet opening of the vortex valve flow control to permit liquid flow from the vortex valve flow control into the drainage outlet of the gully.

FIGS. 5*a*/5*b* and 6*a*/6*b* illustrate two embodiments of the said first element in FIG. 4*a* before attachment to the vortex valve flow control housing.

What is claimed is:

1. A vortex valve flow control comprising a housing defining a vortex chamber having an inlet for introducing a liquid into the vortex chamber in a manner to promote swirl and an outlet in one axial end of the vortex chamber, wherein:

a peripheral wall of the vortex chamber is situated between two end walls and which surrounds the longitudinal axis of the vortex chamber has a circular cylindrical cross-section;

the end walls of the vortex chamber are planar and parallel with each other; and a distance between the end walls as measured at the axis of the flow control of the vortex chamber is no more than 60% of the diameter of the vortex chambe.r

2. A vortex valve flow control according to claim 1, wherein the inlet is an inlet means in the form of an inlet conduit or pipe which is open at both ends, the end thereof which intersects the peripheral wall of the vortex chamber constituting the inlet opening into the vortex chamber.

3. A vortex valve flow control according to claim 1, wherein the intersection between each end wall of the vortex chamber and the cylindrical peripheral wall takes the form of a circumferentially extending concave portion when viewed from inside the vortex chamber having a radius of curvature which is typically less than 25% of the diameter of the vortex chamber.

4. A mounting means for mounting a vortex valve flow control in a drainage gully whereby an outlet of the vortex valve communicates with an outlet from the gully, comprising first and second elements, the first element being securable to an end wall of a vortex valve housing about an outlet opening thereof and the second element being mountable in or adjacent the outlet of the gully, wherein one of the said elements defines a slot which is capable of slidably receiving and locating a head portion of the other of said elements such that the two elements are able to cooperate with each other in a substantially liquid tight manner.

5. A mounting means according to claim 4, wherein one or other or both of the first and second elements is formed integrally with the vortex valve housing and the region of the outlet opening of the gully respectively.

6. A mounting means according to claim 4 wherein the slot defined in one of the said elements is in the shape of a truncated wedge, the wider edge of the wedge serving as the mouth of the slot for slidably receiving the head portion of the second element of the mounting means.

* * * * *